US011111616B2

(12) United States Patent
Hayes et al.

(10) Patent No.: US 11,111,616 B2
(45) Date of Patent: Sep. 7, 2021

(54) PATTERN PRACTICING APPARATUS FOR LONGARM QUILTING MACHINES

(71) Applicants: Keith Hayes, Canton, GA (US); Pamela Hayes, Canton, GA (US)

(72) Inventors: Keith Hayes, Canton, GA (US); Pamela Hayes, Canton, GA (US)

( * ) Notice: Subject to any disclaimer, the term of this patent is extended or adjusted under 35 U.S.C. 154(b) by 0 days.

(21) Appl. No.: 16/895,981

(22) Filed: Jun. 8, 2020

(65) Prior Publication Data

US 2021/0246586 A1 Aug. 12, 2021

Related U.S. Application Data

(60) Provisional application No. 62/924,742, filed on Oct. 23, 2019.

(51) Int. Cl.
*B43L 13/00* (2006.01)
*D05B 11/00* (2006.01)

(52) U.S. Cl.
CPC ..... *D05B 11/00* (2013.01); *B43L 13/007* (2013.01); *D05D 2205/06* (2013.01)

(58) Field of Classification Search
CPC .... D05B 11/00; B43L 13/007; D05D 2205/06
USPC ..... 33/27.12
See application file for complete search history.

(56) References Cited

U.S. PATENT DOCUMENTS 8,074,587 B2 * 12/2011 Olson ..... D05B 11/00 112/117
8,234,989 B2 * 8/2012 Thomas ..... D05B 11/00 112/117
9,021,969 B1 * 5/2015 Roberts ..... B65H 57/003 112/117
9,074,309 B1 * 7/2015 Schwarzberger ..... D05C 7/00
9,228,280 B2 * 1/2016 Bland ..... D05B 21/00
9,267,222 B2 * 2/2016 Schnaufer ..... D05B 19/06
9,394,639 B2 * 7/2016 Ruggles ..... D05B 11/00
2009/0151612 A1 * 6/2009 Bentley ..... D05B 19/12 112/470.04
2011/0094425 A1 * 4/2011 Olson ..... D05B 11/00 112/117
2011/0100276 A1 * 5/2011 Thomas ..... D05B 11/00 112/117
2013/0190916 A1 * 7/2013 Schnaufer ..... D05B 19/12 700/137
2016/0063892 A1 * 3/2016 Elliott ..... G09B 19/20 434/95
2016/0108568 A1 * 4/2016 Ruggles ..... D05B 11/00 112/102.5

(Continued)

*Primary Examiner* — Yaritza Guadalupe-McCall

(74) *Attorney, Agent, or Firm* — Charlena Thorpe, Esq.; Incorporating Innovation LLC

(57) ABSTRACT

Implementations of a pattern practicing apparatus for longarm quilting machines are provided. In some implementations, the pattern practicing apparatus comprises a base, a first handle, and a second handle.

In some implementations, a method for using the pattern practicing apparatus comprises positioning the pattern practicing apparatus on top of a piece of paper or other surface, inserting a writing instrument tip into an opening through the base of the pattern practicing apparatus, holding the handles of the pattern practicing apparatus, and moving the pattern practicing apparatus by the handles across the paper to simulate using a longarm quilting machine free-hand.

20 Claims, 8 Drawing Sheets

(56) References Cited

U.S. PATENT DOCUMENTS

| | | | | |
|---|---|---|---|---|
| 2016/0108569 | A1* | 4/2016 | Schnaufer | D05B 11/00 700/137 |
| 2017/0260666 | A1* | 9/2017 | Schwarzberger | D05B 19/12 |
| 2020/0181820 | A1* | 6/2020 | Mitchell | D05B 11/00 |

* cited by examiner

PATTERN PRACTICING APPARATUS FOR LONGARM QUILTING MACHINES

CROSS REFERENCE TO RELATED APPLICATION

This application claims the benefit of U.S. Patent Application Ser. No. 62/924,742, which was filed on Oct. 23, 2019, and is incorporated herein by reference in its entirety.

TECHNICAL FIELD

This disclosure relates to implementations of a pattern practicing apparatus for longarm quilting machines.

BACKGROUND

As shown in FIG. 1A, a quilt usually comprises a top layer (or quilt top), a batting layer (or quilt batting), and a back layer (or quilt backing). As shown in FIG. 1B, a longarm quilting machine is usually used to sew together a quilt top, quilt batting, and quilt backing into a finished quilt. As shown in FIGS. 1B and 1C, a longarm quilting machine can be used "free-hand" for sewing a quilt. When used free-hand, a user uses the handles of the longarm quilting machine to guide the needle of the machine to sew the quilt components together (as shown in FIG. 1B) and to create sewn patterns on the quilt (as shown in FIG. 1C).

As shown in FIG. 1D, users who are not skilled at guiding the needle of a longarm quilting machine and creating patterns free-hand can use pantograph/tracing technology ("pantograph") to trace a pattern onto the quilt. As shown in FIG. 1D, a user stands behind a longarm quilting machine while using a pantograph to trace a pattern onto the quilt, so the user usually cannot view the pattern while being sewn onto the quilt with the machine. Therefore, it is difficult for unskilled users to use pantographs to learn to quilt patterns free-hand with a longarm quilting machine.

Currently, users have to practice by using longarm quilting machines to become skillful at using the machines free-hand, but such practicing is usually expensive and wasteful. For example, longarm quilting machines are expensive to purchase, therefore users often have to rent the machines for use, but such renting is also expensive. Also, quilt production material has to be used to perform such practicing using the longarm quilting machines, but the material is wasted since it cannot be reused afterward. However, there does not exist an apparatus that allows users to practice to become skillful at using longarm quilting machines free-hand without such expense and waste.

DETAILED DESCRIPTION

Implementations of a pattern practicing apparatus for longarm quilting machines ("pattern practicing apparatus") are provided. In some implementations, the pattern practicing apparatus comprises a base, a first handle, and a second handle.

In some implementations, the pattern practicing apparatus is configured to allow a user to practice and become skillful at using a longarm quilting machine free-hand (i.e., without the use of a pantograph or other tracing technology).

In some implementations, the pattern practicing apparatus is configured to allow a user to practice and become skillful at using a longarm quilting machine free-hand without the expense of having to purchase or rent a longarm quilting machine.

In some implementations, the pattern practicing apparatus is configured to allow a user to practice and become skillful at using a longarm quilting machine free-hand without having to waste quilt production material while using a longarm quilting machine.

In some implementations, the pattern practicing apparatus is configured to allow a user to simulate using a longarm quilting machine free-hand to sew together and/or sew a pattern on a quilt.

In some implementations, the pattern practicing apparatus is configured to allow a user to simulate using a longarm quilting machine with a pantograph to trace/sew a pattern onto the quilt.

In some implementations, the pattern practicing apparatus may be configured to be used for other suitable purposes. For example, in some implementations, the pattern practicing apparatus may be configured to be used as a drawing tool, such as for recreation or entertainment. In some implementations, the pattern practicing apparatus may be configured to be used as a therapeutic device.

In some implementations, a method for using the pattern practicing apparatus comprises a user positioning the pattern practicing apparatus on top of a piece of paper or other surface, inserting a writing instrument tip into an opening through the base of the pattern practicing apparatus, holding the handles of the pattern practicing apparatus, and moving the pattern practicing apparatus by the handles across the paper to simulate using a longarm quilting machine free-hand.

Figure 1A:
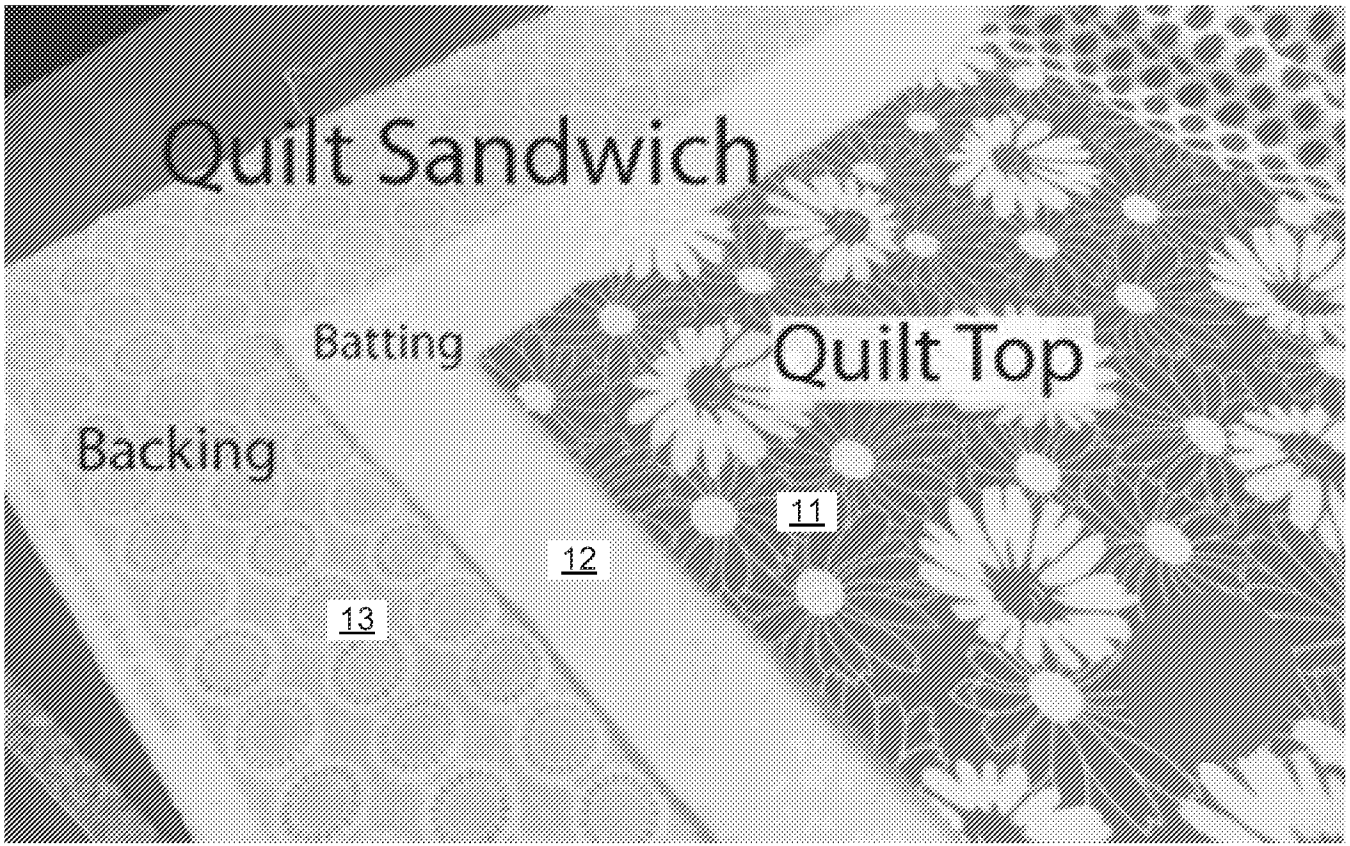
FIG. 1A illustrates the components of an example existing quilt.
Figure 1B:
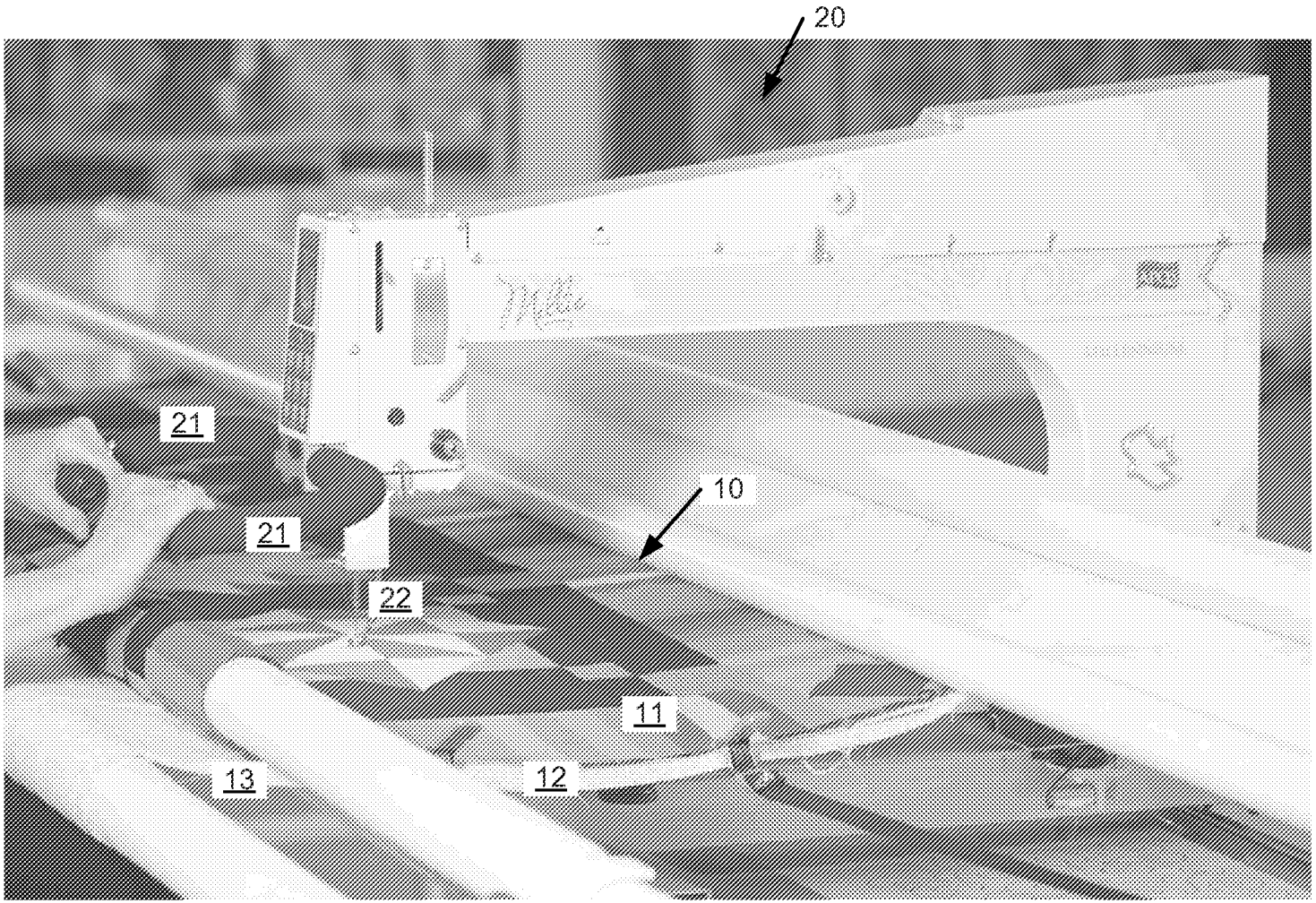
FIG. 1B illustrates an example existing longarm quilting machine being used to sew quilt components such as illustrated in FIG. 1A together into a quilt.

FIG. 1A illustrates the components of an example existing quilt 10. As shown in FIG. 1A, a quilt 10 usually comprises a top layer (or quilt top) 11, a batting layer (or quilt batting) 12, and a back layer (or quilt backing) 13. FIG. 1B illustrates an example existing longarm quilting machine 20 being used to sew quilt components 11, 12, 13 such as illustrated in FIG. 1A together into a quilt 10. As shown in FIG. 1B, a longarm quilting machine 20 is usually used to sew together a quilt top 11, quilt batting 12, and quilt backing 13 into a finished quilt 10.

Figure 1C:
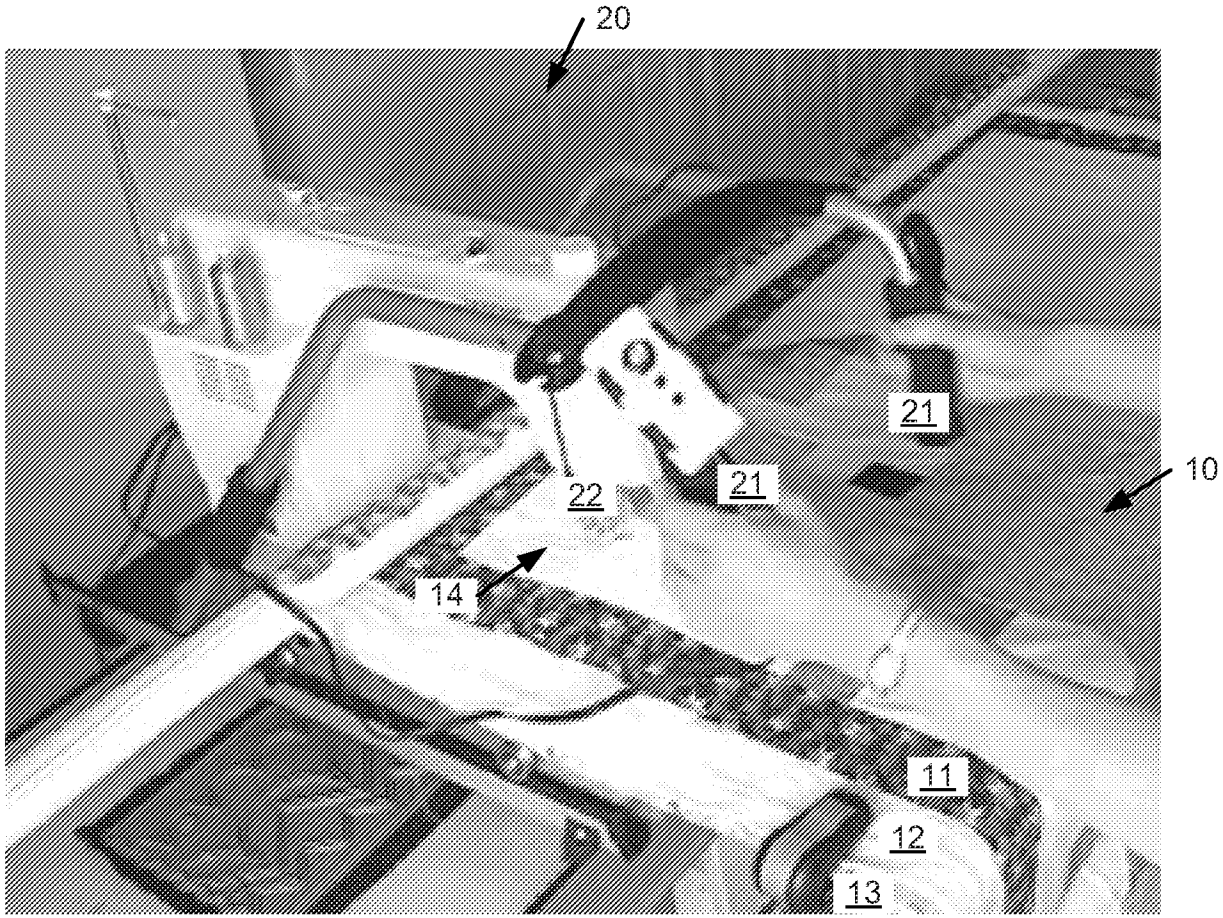
FIG. 1C illustrates an example existing longarm quilting machine such as illustrated in FIG. 1B being used free-hand to sew patterns onto a quilt such as also illustrated in FIG. 1B.

FIG. 1C illustrates an example existing longarm quilting machine 20 such as illustrated in FIG. 1B being used free-hand to sew patterns 14 onto a quilt 10 such as also illustrated in FIG. 1B. As shown in FIGS. 1B and 1C, a longarm quilting machine 20 can be used "free-hand" for sewing a quilt 10. When used free-hand, a user uses the handles 21 of the longarm quilting machine 20 to guide the needle 22 of the machine 20 to sew the quilt components 11, 12, 13 together (as shown in FIG. 1B) and to create sewn patterns 14 on the quilt 10 (as shown in FIG. 1C).

Figure 1D:
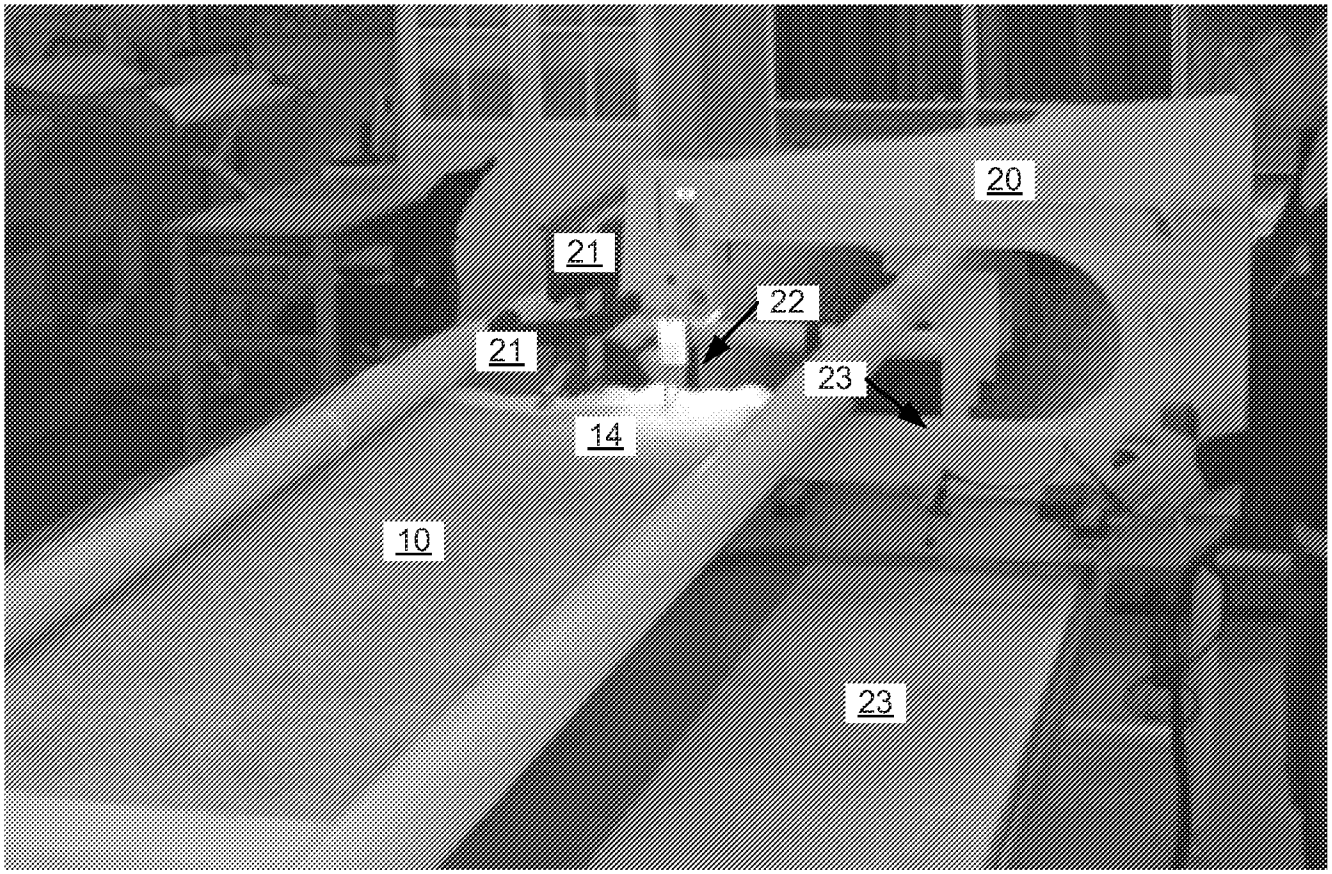
FIG. 1D illustrates an example existing longarm quilting machine such as illustrated in FIG. 1B being used with pantograph/tracing technology to sew patterns onto a quilt such as also illustrated in FIG. 1B.

FIG. 1D illustrates an example existing longarm quilting machine 20 such as illustrated in FIG. 1B being used with pantograph/tracing technology 23 to sew patterns 14 onto a quilt 10 such as also illustrated in FIG. 1B. As shown in FIG. 1D, users who are not skilled at guiding the needle 22 of a longarm quilting machine 20 and creating patterns 14 free-hand can use pantograph/tracing technology ("pantograph") 23 to trace a pattern 14 onto the quilt 10. As shown in FIG. 1D, a user stands behind a longarm quilting machine 20 while using a pantograph 23 to trace a pattern 14 onto the quilt 10, so the user usually cannot view the pattern 14 while being sewn onto the quilt 10 with the machine 20. Therefore, it is difficult for unskilled users to use pantographs 23 to learn to quilt patterns 14 free-hand with a longarm quilting machine 20.

Currently, users have to practice by using longarm quilting machines 20 to become skillful at using the machines 20 free-hand, but such practicing is usually expensive and wasteful. For example, longarm quilting machines 20 are expensive to purchase, therefore users often have to rent the machines 20 for use, but such renting is also expensive. Also, quilt production material 11, 12, 13 has to be used to perform such practicing using the longarm quilting machines 20, but the material 11, 12, 13 is wasted since it cannot be reused afterward.

Figure 2A:
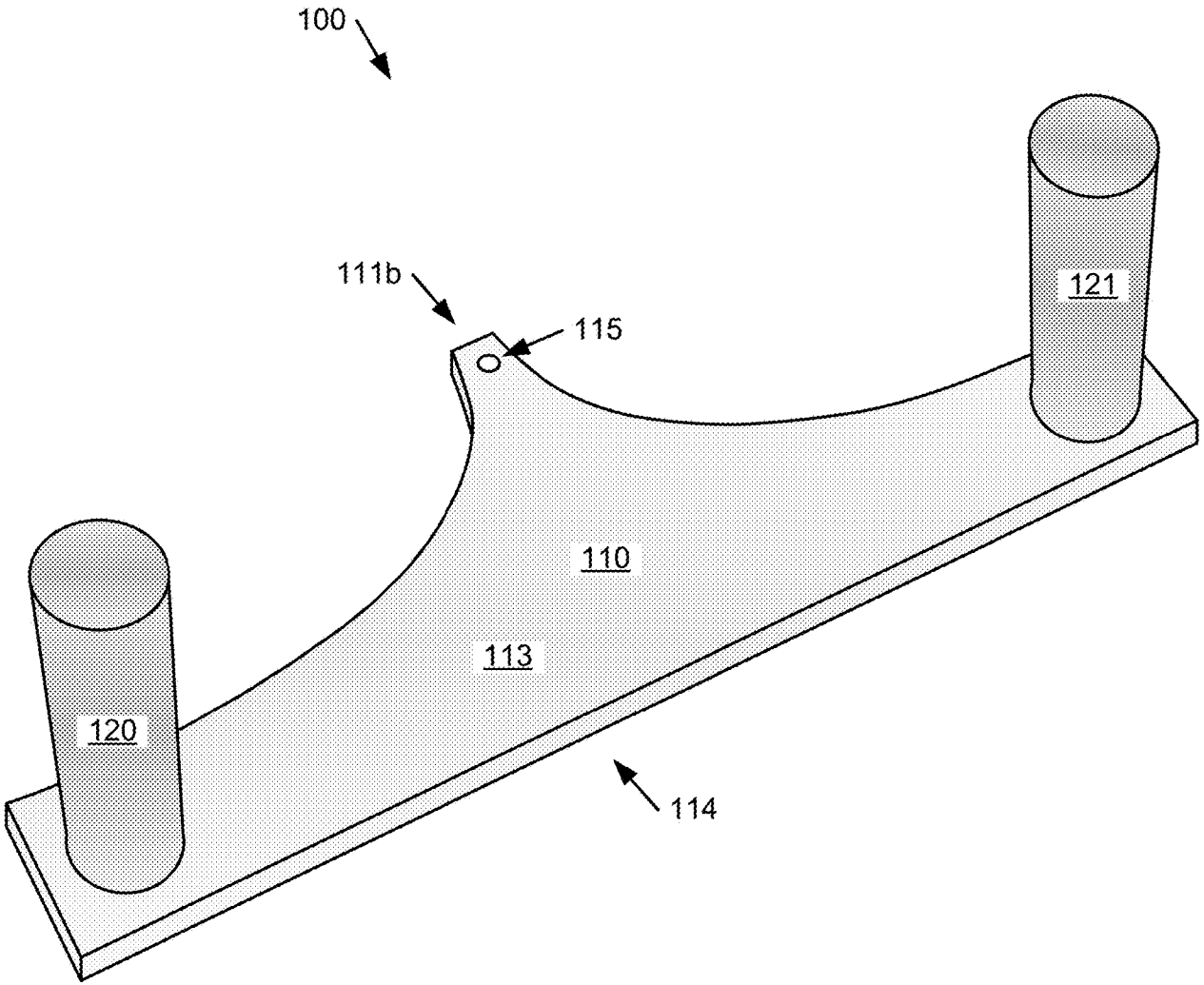
FIGS. 2A-2C illustrates an implementation of an example pattern practicing apparatus for longarm quilting machines according to the present disclosure.
Figure 2B:
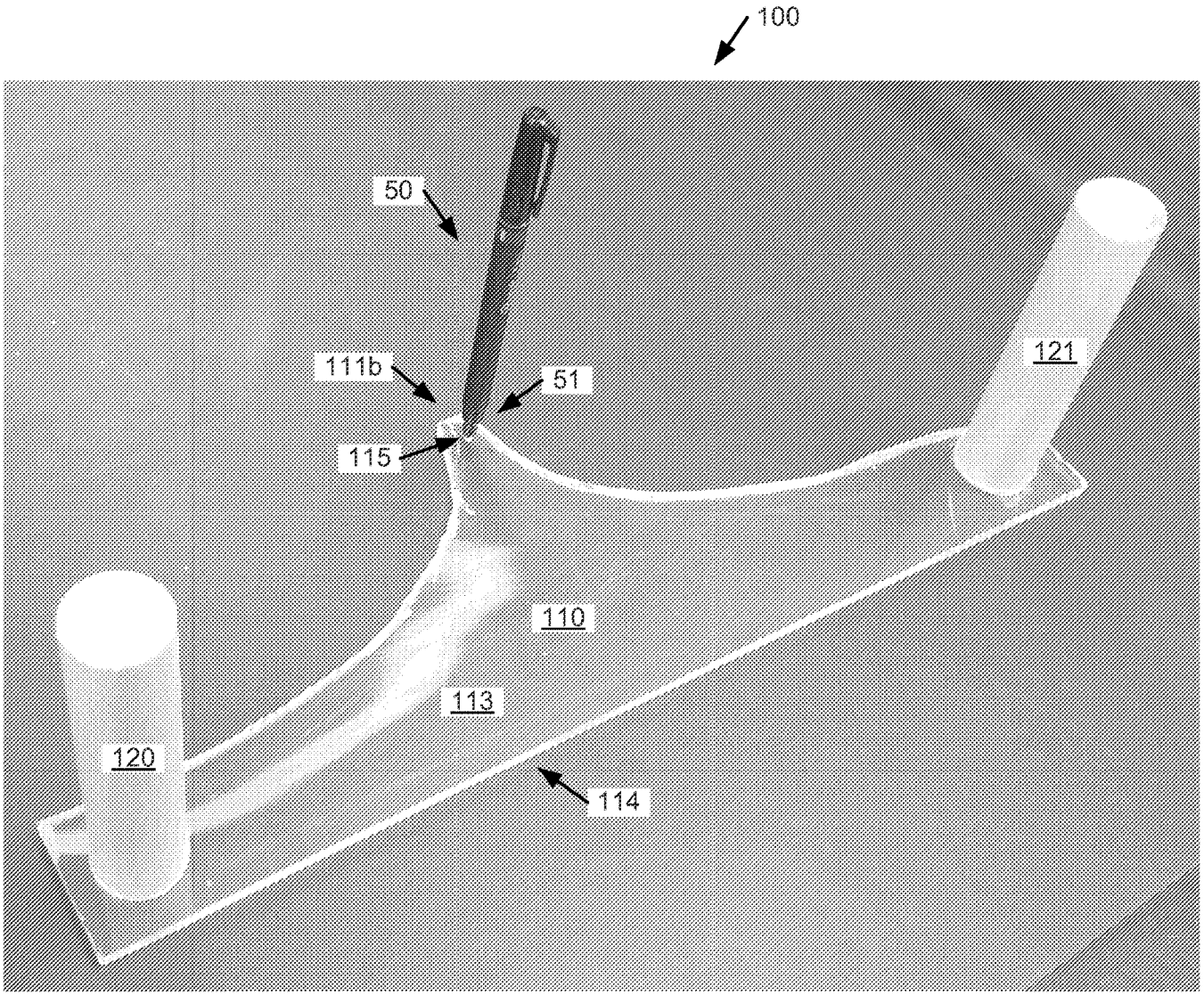
Figure 2C:
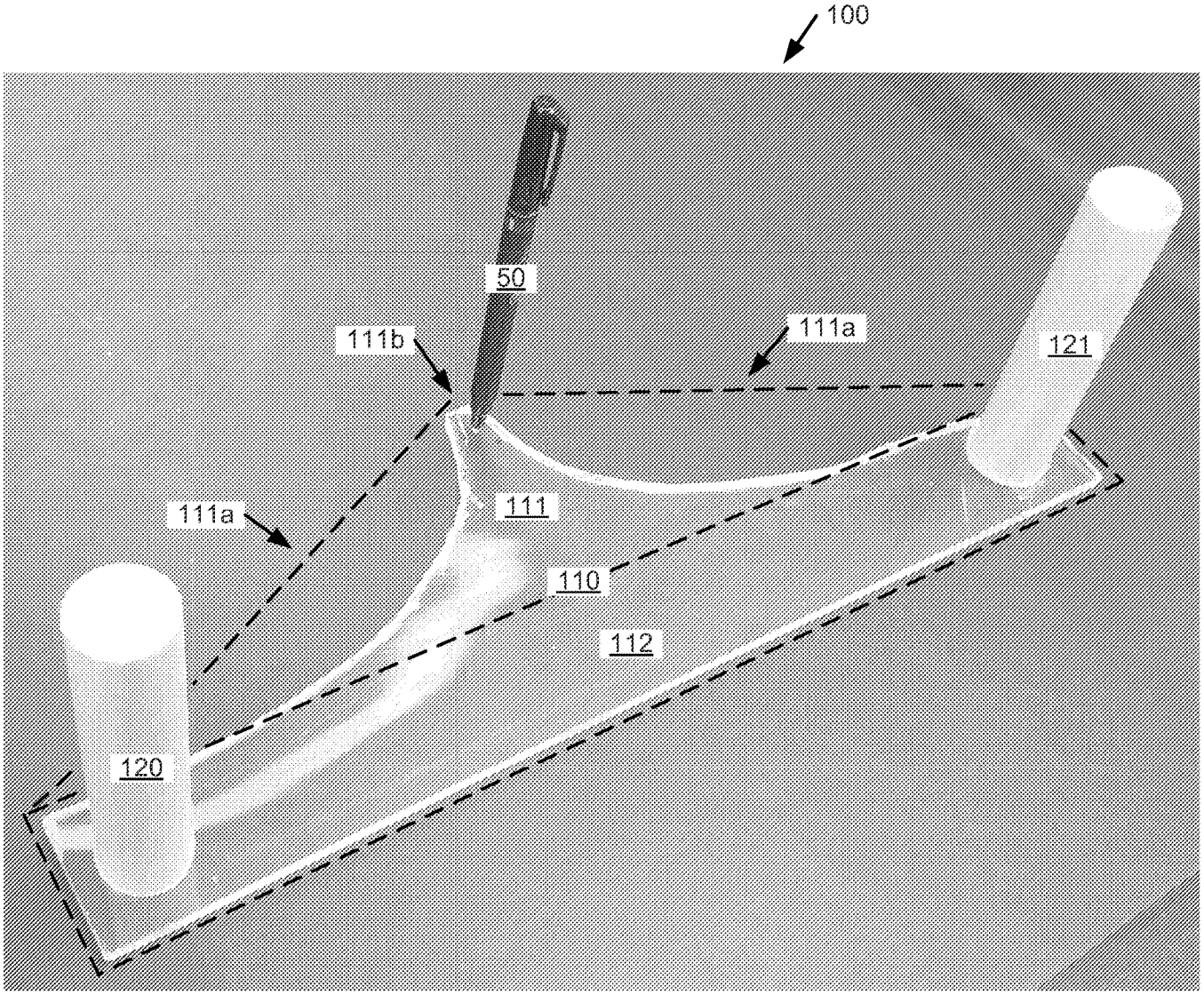

FIGS. 2A-2C illustrate an implementation of an example pattern practicing apparatus for longarm quilting machines ("pattern practicing apparatus") 100 according to the present disclosure. As shown in FIG. 2A, in some implementations, the pattern practicing apparatus 100 comprises a base 110, a first handle 120, and a second handle 121.

As shown in FIG. 2A, in some implementations, the base 110 comprises a top surface 113, a bottom surface 114, and an opening 115.

In some implementations, the top surface 113 extends lengthwise and widthwise.

In some implementations, the bottom surface 114 extends lengthwise and widthwise opposite the top surface 113.

In some implementations, the base 110 may be any suitable shape. For example, in some implementations, the top and bottom surfaces 113, 114 may each extend lengthwise between a first side and a second side of the base 110 and extend widthwise between a third side and a fourth side of the base 110.

As shown in FIG. 2C, in some implementations, the base 110 may comprise a triangular or semi-triangular shaped portion 111 and a rectangular or semi-rectangular shaped portion 112. In some implementations, the shape of the base 110 may comprise a combination of the triangular shaped portion 111 extending from the rectangular shaped portion 112.

As shown in FIG. 2C, in some implementations, the semi-triangular shaped portion 111 may comprise curved (e.g., concave shaped) sides 111*a*. In some implementations, the sides 111*a* may be straight or generally straight.

In some implementations, the sides 111*a* may be any other suitable shape.

In some implementations, the triangular shaped portion 111 may comprise an apex 111*b*. In some implementations, a portion of the apex 111*b* may be straight or generally straight. In some implementations, the apex 111*b* may be any other suitable shape.

In some implementations, the triangular shaped portion 111 may comprise any other suitably shaped features.

In some implementations, the base 110 may be flat or generally flat. For example, in some implementations, the top surface 113 and/or other bottom surface 114 may be flat or generally flat.

In some implementations, the base 110 may be any other suitable shape.

In some implementations, the opening 115 extends through the base 110 including through the top and bottom surfaces 113, 114.

As shown in FIG. 2A, in some implementations, the opening 115 is positioned on the base 110 in relation to the handles 120, 121 of the pattern practicing apparatus 100 (described below) the same as the needle 22 is positioned on a longarm quilting machine 20 in relation to the handles 21 of the longarm quilting machine 20 (described above for FIGS. 1B-1C).

As described more below, in some implementations, the opening 115 and the handles 120, 121 may be positioned spaced apart on the base 110 in a triangular or other suitable pattern.

As shown in FIG. 2A, in some implementations, the opening 115 may be positioned adjacent to the apex 111*b*. In some implementations, the opening 115 may be positioned at any other suitable position of the base 110.

As shown in FIG. 2B, in some implementations, the opening 115 is configured to receive the tip (e.g., bottom/writing end) 51 of a writing instrument 50 within the opening 115. In some implementations, the opening 115 may be configured to receive the tip 51 such that the writing instrument 50 is securely held within the opening 115 while extending perpendicular or generally perpendicular from the top surface 113 of the base 110.

In some implementations, the opening 115 is configured to receive the tip 51 such that the writing instrument 50 marks or writes on a piece of paper or other surface positioned under the base 110 adjacent to the bottom surface 114 as the pattern practicing apparatus 100 is moved, as described below with respect to using the pattern practicing apparatus for longarm quilting machines 100.

In some implementations, the writing instrument 50 may be a pen, pencil, or marker. In some implementations, the writing instrument 50 may be any other suitable writing instrument.

As shown in FIG. 2B, in some implementations, the base 110 may be clear or transparent. In some implementations, the base 110 may be transparent such that a user can clearly and/or legibly see through the base 110. For example, in some implementations, the base 110 may be transparent such that a user can clearly and/or legibly see lines, markings, etc. through the base 110. In some implementations, such lines, markings, etc. may be on a piece of paper or other surface positioned under the base 110 adjacent to the bottom surface 114, such as described below with respect to using the pattern practicing apparatus for longarm quilting machines 100.

In some implementations, the base 110 may be composed of a clear, durable, semi-flexible plastic pane material, such as an acrylic material. In some implementations, the base 110 may be composed of any other suitable material.

As shown in FIG. 2A, in some implementations, the base 110 is configured to provide the opening 115. In some implementations, the base 110 is configured to position the opening 115 in relation to the handles 120, 121 of the pattern practicing apparatus 100 the same or similar to as the needle 22 is positioned on a longarm quilting machine 20 in relation to the handles 21 of the longarm quilting machine 20 (such as shown in FIGS. 1B-1C).

In some implementations, as described below with respect to using the pattern practicing apparatus for longarm quilting machines 100, the base 110 is configured to be moved (e.g., to slide or glide) across a piece of paper or other surface positioned under the base 110 adjacent to the bottom surface 114. In some implementations, as also described below with respect to using the pattern practicing apparatus for longarm quilting machines 100, the base 110 is configured to hold a writing instrument 50 such that the writing instrument 50 marks or writes on the piece of paper or other surface positioned under the base 110 as the pattern practicing apparatus 100 is moved.

Furthermore, in some implementations, the base 110 is configured to allow a user to clearly see lines, markings, etc. on the piece of paper or other surface positioned under the base 110 through the base 110, such as that are made by the writing instrument 50 or that are pre-made (e.g., for tracing).

In this way, in some implementations, the base 110 is configured to allow a pattern practicing apparatus 100 user to simulate using a longarm quilting machine 20 free-hand to sew together and/or sew a pattern 14 onto a quilt 10, such as described above for FIGS. 1B-1C. Furthermore, in this way, in some implementations, the base 110 is configured to allow a pattern practicing apparatus 100 user to simulate using a longarm quilting machine 20 with a pantograph 23 to trace/sew a pattern 14 onto the quilt 10, such as described above for FIG. 1D.

As shown in FIG. 2A, in some implementations, the first handle 120 and the second handle 121 are the same or similar to each other.

In some implementations, the handles 120, 121 comprise a cylindrical shape, e.g. that is the same or similar to the shape of the handles 21 of a longarm quilting machine 20 (such as shown in FIGS. 1B-1C). In some implementations, the shape of the handles 120, 121 are the same or similar to the shape of the handles 21 of a longarm quilting machine 20 in any other suitable way. In some implementations, the handles 120, 121 may comprise any other suitable shape.

As shown in FIG. 2A, in some implementations, the handles 120, 121 are attached or connected to the base 110. For example, in some implementations, the handles 120, 121 are attached to the top surface 113 of the base 110. In some implementations, the handles may be attached to any other suitable part of the base 110.

In some implementations, the handles 120, 121 extend upward from the base 110 at a ninety (90) degree angle, i.e. perpendicularly to the base 110. For example, in some implementations, the handles 120, 121 extend perpendicularly from the top surface 113 of the base 110. In some implementations, the handles 120, 121 may extend from the base 110 in any other suitable way.

As shown in FIG. 2C, in some implementations, the handles 120, 121 may be attached to and extend from the semi-rectangular shaped portion 112 of the base 110. For example, in some implementations, the handles 120, 121 may be respectively attached to and extend from the semi-rectangular shaped portion 112 adjacent to the opposite ends of the elongated length of the portion 112. In some implementations, the handles 120, 121 may be attached to and extend from any other suitable portion of the base 110.

As shown in FIG. 2A, in some implementations, the handles 120, 121 are attached to the base 110 in the same or similar positioning as the handles 21 are attached to a longarm quilting machine 20. For example, in some implementations, the handles 120, 121 are attached to the base 110 spaced apart the same or similar distance as the handles 21 are spaced apart on a longarm quilting machine 20.

In some implementations, the handles 120, 121 may be attached to and extend from any other suitable position of the base 110.

As shown in FIG. 2A, in some implementations, the opening 115, the first handle 120, and the second handle 121 may be positioned spaced apart on the base 110 in a triangular pattern. In some implementations, the opening 115, the first handle 120, and the second handle 121 may be positioned spaced apart on the base 110 in any other suitable arrangement.

In some implementations, the handles 120, 121 are composed of a material that provides the same or similar feel to holding the handles 21 of a longarm quilting machine 20. For example, in some implementations, the handles 120, 121 may be composed of a semi-firm, semi-compressible material, such as a dense foam material. In some implementations, the handles 120, 121 may be composed of any other suitable material.

In some implementations, the handles 120, 121 are configured to simulate the handles 21 of a longarm quilting machine 20, such as in the ways described above. For example, in some implementations, the handles 120, 121 are configured to simulate the shape, positioning, feel, etc. of the handles 21 of a longarm quilting machine 20.

In some implementations, the handles 120, 121 are configured to allow a user to move the pattern practicing apparatus 100 to simulate free-hand use of a longarm quilting machine 20. For example, in some implementations, the handles 120, 121 are configured to allow a user to move (e.g., slide or glide) the base 110 across a piece of paper or other surface positioned under the base 110 adjacent to the bottom surface 114, such as described below with respect to using the pattern practicing apparatus for longarm quilting machines 100. In this way, in some implementations, the handles 120, 121 are configured to allow a pattern practicing apparatus 100 user to simulate using a longarm quilting machine 20 free-hand to sew together and/or sew a pattern 14 onto a quilt 10, such as described above for FIGS. 1B-1C.

In some implementations, the handles 120, 121 may be the same or similar to the handles 21 of the longarm quilting machine 20 in any other suitable way.

In some implementations, the pattern practicing apparatus 100 is configured to allow a user to practice and become skillful at using a longarm quilting machine 20 free-hand (i.e., without the use of a pantograph 23 or other tracing technology).

In some implementations, the pattern practicing apparatus 100 is configured to allow a user to practice and become skillful at using a longarm quilting machine 20 free-hand without the expense of having to purchase or rent a longarm quilting machine 20.

In some implementations, the pattern practicing apparatus 100 is configured to allow a user to practice and become skillful at using a longarm quilting machine 20 free-hand without having to waste quilt production material 11, 12, 13 while using a longarm quilting machine 20.

In some implementations, the pattern practicing apparatus 100 is configured to allow a user to simulate using a longarm quilting machine 20 free-hand to sew together and/or sew a pattern 14 onto a quilt 10, such as described above for FIGS. 1B-1C.

In some implementations, the pattern practicing apparatus 100 is configured to allow a user to simulate using a longarm quilting machine 20 with a pantograph 23 to trace/sew a pattern 14 onto the quilt 10, such as described above for FIG. 1D.

In some implementations, the pattern practicing apparatus 100 may be configured to be used for other suitable purposes. For example, in some implementations, the pattern practicing apparatus 100 may be configured to be used as a drawing tool, such as for recreation or entertainment. In some implementations, the pattern practicing apparatus 100 may be configured to be used as a therapeutic device.

In some implementations, the pattern practicing apparatus 100 comprises any suitable dimensions.

In some implementations, the pattern practicing apparatus 100 is composed of any suitable materials, such as the example materials described above.

In some implementations, the pattern practicing apparatus 100 can have any suitable appearance, such as the example appearances shown in the above described FIGs.

Figure 3:
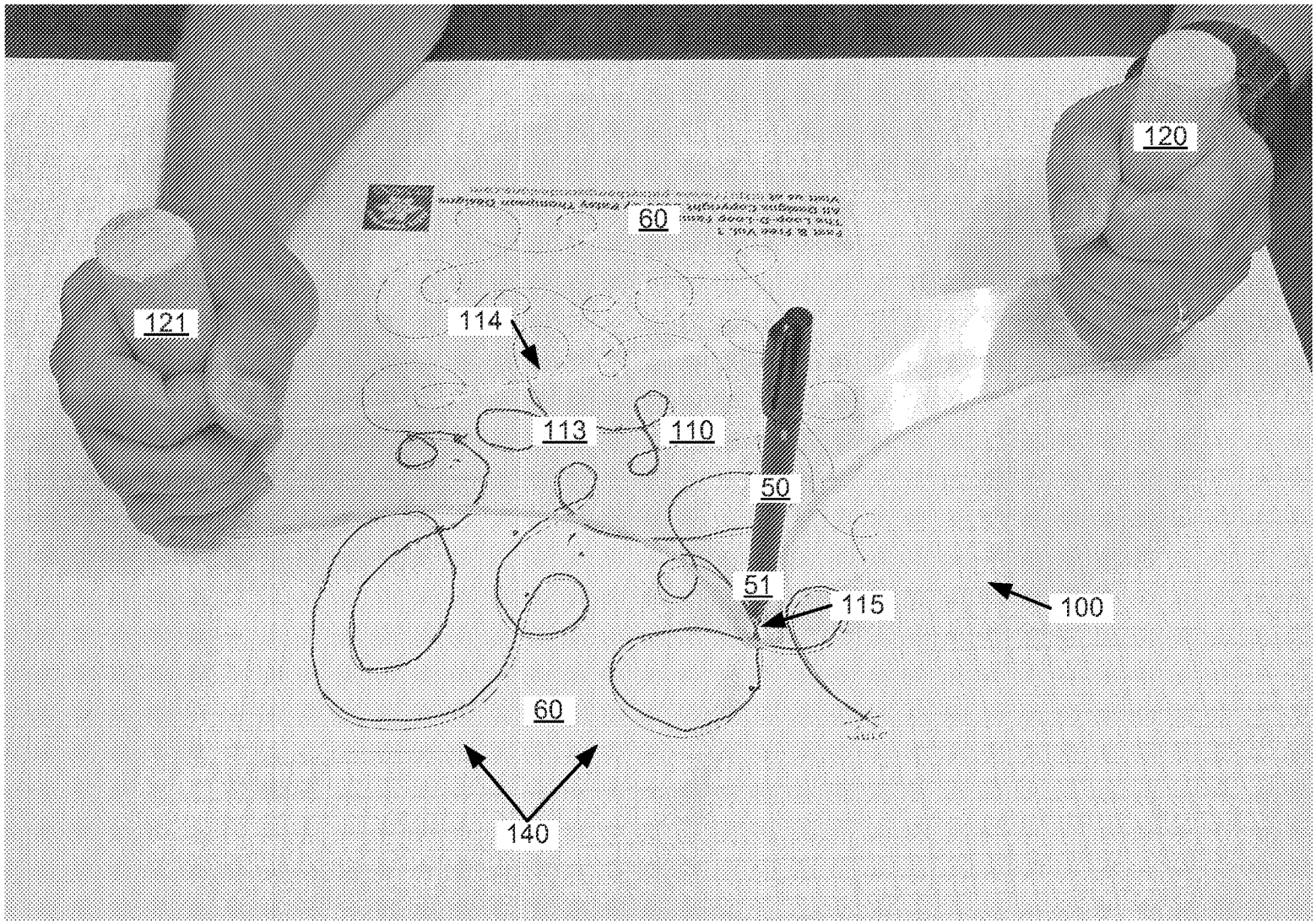
FIG. 3 illustrates an example use of the pattern practicing apparatus for longarm quilting machines illustrated in FIGS. 2A-2C according to the present disclosure.

FIG. 3 illustrates an example use of the pattern practicing apparatus for longarm quilting machines ("pattern practicing apparatus") 100 illustrated in FIGS. 2A-2C according to the present disclosure. In some implementations, an example method of using the pattern practicing apparatus 100, with respect to FIG. 3 and the other above-described FIGs., comprises a user positioning the pattern practicing apparatus 100 on top of a piece of paper 60 or other surface.

In some implementations, the pattern practicing apparatus 100 is positioned such that the paper 60 is positioned under the base 110 adjacent to the bottom surface 114 of the pattern practicing apparatus 100. In some implementations, the paper 60 is positioned on a supporting surface, such as a table top or other suitable supporting surface.

In some implementations, the method comprises the user inserting the tip 51 of a writing instrument 50 into the opening 115 through the base 110 of the pattern practicing apparatus 100. In some implementations, the writing instrument tip 51 may be inserted into the opening 115 such that the writing instrument 50 is secured within the opening 115 while extending perpendicular or generally perpendicular from the top surface 113 of the base 110. In some implementations, the writing instrument tip 51 is inserted into the opening 115 also such that the writing instrument 50 marks or writes on the paper 60 when the pattern practicing apparatus 100 is moved across the paper 60.

In some implementations, the method comprises the user holding the handles 120, 121 of the pattern practicing apparatus 100. In some implementations, the handles are held the same or similar to how the user would hold the handles 21 of a longarm quilting machine 20.

In some implementations, the method comprises the user moving the pattern practicing apparatus 100 by the handles 120, 121 across the paper 60. In some implementations, the pattern practicing apparatus 100 is moved such that the bottom surface 114 of the base 110 slides or glides across the paper 60. In some implementations, the pattern practicing apparatus 100 is also moved such that the writing instrument 50 writes or otherwise marks on the paper 60 as the pattern practicing apparatus 100 is moved, such as to draw a pattern 140 on the paper 60 that simulates a sewn pattern 14 on a quilt 10.

In this way, in some implementations, the pattern practicing apparatus 100 allows the user to simulate using a longarm quilting machine 20 free-hand to sew together and/or sew a pattern 14 onto a quilt 10, and the pattern practicing apparatus 100 thereby draws a corresponding simulated pattern 140 on the paper 60.

In some implementations, the user sees/views the simulated pattern 140 through the transparent base 110 of the pattern practicing apparatus 100 as the pattern 140 is drawn on the paper 60 by moving the pattern practicing apparatus 100 in order to draw the pattern 140 (i.e., to simulate sewing the pattern 14) as accurately as possible. In some implementations, the user may draw the pattern 140 free-hand using the pattern practicing apparatus 100 based on looking at a guide pattern (e.g., a separate posted drawing of the pattern).

Alternately, in some implementations, moving the pattern practicing apparatus 100 for the method as described above allows the user to simulate using a longarm quilting machine 20 with pantograph/tracing technology 23 to sew together and/or sew a pattern 14 onto a quilt 10. In some implementations, such longarm quilting machine 20/pantograph 23 use is simulated by the user moving the pattern practicing apparatus 100 such that the writing instrument 50 traces over a pre-made (e.g., pre-drawn) pattern 140 on the paper 60. In some implementations, the user sees/views the pre-made pattern 140 through the transparent base 110 of the pattern practicing apparatus 100 to trace the pattern 140 on the paper 60 with the writing instrument 50 as closely as possible by moving the pattern practicing apparatus 100 across the paper 60.

In some implementations, by the method, the user can practice becoming skillful at using a longarm quilting machine 20 free-hand without using expensive equipment or wasting material, such as also described above with respect to the pattern practicing apparatus 100.

In some implementations, another example method of using the pattern practicing apparatus 100 may comprise using the pattern practicing apparatus 100 for other suitable purposes, such as using the pattern practicing apparatus 100 as a drawing tool or as a therapeutic device.

In some implementations, the pattern practicing apparatus 100 may be configured to be used for other suitable purposes. For example, in some implementations, the pattern practicing apparatus 100 may be configured to be used as a drawing tool, such as for recreation or entertainment. In some implementations, the pattern practicing apparatus 100 may be configured to be used as a therapeutic device.

The figures, including photographs and drawings, comprised herewith may represent one or more implementations of the pattern practicing apparatus for longarm quilting machines.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. A pattern practicing apparatus, the apparatus comprising:

a base, a first handle, and a second handle, wherein:

the base comprises a piece of material having:

a first surface extending length-wise and width-wise;

a second surface, opposite the first surface, extending length-wise and width-wise; and an opening extending through the piece of material including through the first surface and the second surface, wherein a portion of the piece of material completely encircles the opening such that the opening does not extend to and through an outermost edge of the piece of material and the opening is configured to receive at least a portion of a writing instrument such that when the second surface of the base is moved across a surface, the writing instrument positioned in the opening can mark the surface;

the first handle comprises a first elongated piece of material that extends from the first surface of the base;

the second handle comprises a second elongated piece of material that extends from the first surface of the base; and the opening, the first handle, and the second handle are spaced apart in a triangular pattern.

2. The pattern practicing apparatus of claim 1, wherein:

the first handle and the second handle are spaced apart the same as the handles of a longarm quilting machine are spaced apart; and the opening is spaced apart from the first handle and the second handle the same as the needle of the longarm quilting machine is spaced apart from the handles of the longarm quilting machine.

3. The pattern practicing apparatus of claim 1, wherein:

the base further comprises a first side, a second side, a third side, and a fourth side;

the first surface of the base extends length-wise from the first side to the second side of the base and extends width-wise from the third side to the fourth side of the base; and the second surface of the base extends length-wise from the first side to the second side of the base and extends width-wise from the third side to the fourth side of the base.

4. The pattern practicing apparatus of claim 3, wherein:

the opening is positioned adjacent to the third side of the base;

the first handle is positioned adjacent to the fourth side of the base; and the second handle is positioned adjacent to the fourth side of the base.

5. The pattern practicing apparatus of claim 4, wherein:

the third side of the base extends outward to an apex between the first side and the second side of the base thereby forming a triangular shaped portion of the base; and the opening is positioned adjacent to the apex.

6. The pattern practicing apparatus of claim 5, wherein:

the third side of the base curves inward extending between the first side and the apex of the base; and the third side curves inward extending between the second side and the apex of the base.

7. The pattern practicing apparatus of claim 1, wherein the base is transparent.

8. The pattern practicing apparatus of claim 1, wherein:

the first handle is cylindrical; and the second handle is cylindrical.

9. The pattern practicing apparatus of claim 1, wherein:

the base is composed of an acrylic material;

the first handle is composed of a foam material; and the second handle is composed of the foam material.

10. A method of using the pattern practicing apparatus of claim 1, comprising:

positioning the base of the apparatus on a piece of a paper such that the second surface of the base is adjacent to the paper;

positioning a writing instrument in the opening of the base;

holding the first handle and the second handle; and moving the base by the first and second handles such that the second surface of the base moves across the paper and the writing instrument marks on the paper through the opening of the base thereby simulating sewing with a longarm quilting machine.

11. The method of claim 10, further comprising:

providing a guide pattern marked on a separate surface; and viewing the guide pattern on the separate surface;

wherein moving the base comprises moving the base such that the piece of paper is marked by the writing instrument with respect to the guide pattern viewed on the separate surface.

12. The method of claim 10, further comprising providing the piece of paper with a pre-drawn pattern marked thereon, wherein moving the base comprises moving the base such that the piece of paper is marked by the writing instrument with respect to the pre-drawn pattern on the piece of paper.

13. A method of using the pattern practicing apparatus of claim 7, comprising:

positioning the base of the apparatus on a piece of a paper such that the second surface of the base is adjacent to the paper;

positioning a writing instrument in the opening of the base;

holding the first handle and the second handle;

moving the base by the first and second handles such that the second surface of the base moves across the paper and the writing instrument marks on the paper through the opening of the base thereby simulating sewing with a longarm quilting machine; and viewing through the base a pattern marked on the paper by the writing instrument as the base is moved.

14. A pattern practicing apparatus the apparatus comprising:

a base, a first handle, and a second handle, wherein:

the base comprises a piece of material having a first surface, a second surface, a first side, a second side, a third side, a fourth side, and an opening, wherein:

the first surface extends length-wise from the first side to the second side and extends width-wise from the third side to the fourth side;

the second surface is opposite the first surface and extends length-wise from the first side to the second side and extends width-wise from the third side to the fourth side; and the opening extends through the base including through the first surface and the second surface, wherein a portion of the piece of material completely encircles the opening such that the opening does not extend to and through an outermost edge of the piece of material and the opening is configured to receive at least a portion of a writing instrument such that when the second surface of the base is moved across a surface, the writing instrument positioned in the opening can mark the surface;

the third side of the base extends outward to an apex between the first side and the second side of the base thereby forming a triangular shaped portion of the base;

the base is transparent;

the first handle comprises a first elongated piece of material that extends from the first surface of the base;

the second handle comprises a second elongated piece of material that extends from the first surface of the base; and the opening, the first handle, and the second handle are spaced apart in a triangular pattern, wherein the opening is positioned adjacent to the apex of the third side of the base, the first handle is positioned adjacent to the fourth side of the base, and the second handle is positioned adjacent to the fourth side of the base.

15. The pattern practicing apparatus of claim 14, wherein:

the first handle and the second handle are spaced apart the same as the handles of a longarm quilting machine are spaced apart; and the opening is spaced apart from the first handle and the second handle the same as the needle of the longarm quilting machine is spaced apart from the handles of the longarm quilting machine.

16. The pattern practicing apparatus of claim 14, wherein:

the third side of the base curves inward extending between the first side and the apex of the base; and the third side curves inward extending between the second side and the apex of the base.

17. A method of using the pattern practicing apparatus of claim 14, comprising:

positioning the base of the apparatus on a piece of a paper such that the second surface of the base is adjacent to the paper;

positioning a writing instrument in the opening of the base;

holding the first handle and the second handle; and moving the base by the first and second handles such that the second surface of the base moves across the paper and the writing instrument marks on the paper through the opening of the base thereby simulating sewing with a longarm quilting machine.

18. The method of claim 17, further comprising viewing through the base a pattern marked on the paper by the writing instrument as the base is moved.

19. The method of claim 17, further comprising:

providing a guide pattern marked on a separate surface; and viewing the guide pattern on the separate surface;

wherein moving the base comprises moving the base such that the piece of paper is marked by the writing instrument with respect to the guide pattern viewed on the separate surface.

20. The method of claim 17, further comprising providing the piece of paper with a pre-drawn pattern marked thereon, wherein moving the base comprises moving the base such that the piece of paper is marked by the writing instrument with respect to the pre-drawn pattern on the piece of paper.

* * * * *